US008058587B2

(12) United States Patent
Kohira

(10) Patent No.: US 8,058,587 B2
(45) Date of Patent: Nov. 15, 2011

(54) THERMAL ACTIVATION PRINTER

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 968 days.

(21) Appl. No.: 12/009,861

(22) Filed: Jan. 22, 2008

(65) Prior Publication Data

US 2008/0179308 A1 Jul. 31, 2008

(30) Foreign Application Priority Data

Jan. 22, 2007 (JP) ..... 2007-011064

(51) Int. Cl.

| | |
|---|---|
| ***B41J 2/32*** | (2006.01) |
| ***B41J 11/22*** | (2006.01) |
| ***B41J 11/58*** | (2006.01) |
| ***B41J 13/10*** | (2006.01) |
| ***F27B 9/14*** | (2006.01) |
| ***B65C 9/08*** | (2006.01) |
| ***B65C 9/25*** | (2006.01) |

(52) U.S. Cl. .... 219/216; 219/388; 347/197; 400/120.01

(58) Field of Classification Search ..... None
See application file for complete search history.

(56) References Cited

U.S. PATENT DOCUMENTS

| | | | | |
|---|---|---|---|---|
| 6,371,481 | B1 | 4/2002 | Miyake | 271/314 |
| 6,877,917 | B2 * | 4/2005 | Hoshino et al. | 400/120.01 |
| 6,975,340 | B2 * | 12/2005 | Hoshino et al. | 347/197 |
| 7,420,578 | B2 * | 9/2008 | Kohira | 347/197 |
| 2001/0001273 | A1 * | 5/2001 | Mori et al. | 400/120.01 |
| 2005/0274706 | A1 * | 12/2005 | Hoshino et al. | 219/216 |

FOREIGN PATENT DOCUMENTS

| | | |
|---|---|---|
| EP | 1136405 | 9/2001 |
| EP | 1634717 | 3/2006 |
| EP | 1637334 | 3/2006 |

* cited by examiner

*Primary Examiner* — Joseph M Pelham
(74) *Attorney, Agent, or Firm* — Adams & Wilks

(57) ABSTRACT

The present invention includes: a printing portion (12) for performing printing on a printing layer of a sheet material (5) including a sheet-like base having one surface provided with the printing layer and another surface provided with a heat-sensitive adhesive layer; a thermal activation portion (15) for heating the heat-sensitive adhesive layer of the sheet material (5) and generating an adhesive force; a temporary stock portion (14), which is disposed in a transport path for the sheet material (5) between the printing portion (12) and the thermal activation portion (15), for temporarily stocking the sheet material (5); and a casing (19) covering the temporary stock portion (14). The temporary stock portion (14) includes a reversing portion (21) provided with a transport path (21*a*) having an arc shape, for reversing a transport direction of the sheet material (5) transported from the printing portion (12) and a stock portion (22), which has a straight line shape and is provided continuously to the reversing portion (21), for stocking the sheet material (5) in a flat state, the reversing portion (21) and the stock portion (22) being formed along an inner peripheral portion of the casing (19).

5 Claims, 3 Drawing Sheets

THERMAL ACTIVATION PRINTER

BACKGROUND OF THE INVENTION

1. Field of the Invention

The present invention relates to a thermal activation printer in which a heat-sensitive adhesive layer of a sheet material is heated to generate an adhesion force after temporarily stocking a sheet material on which printing has been performed.

2. Description of the Related Art

As a label used by being stuck to goods, there is known a label including a sheet-like base having one surface provided with a printing layer and another surface provided with a heat-sensitive adhesive layer.

The printer for printing the label having the heat-sensitive adhesive layer as described above generally includes a sheet supplying device for supplying the sheet material, a printing device for printing various information on a printing layer of the sheet material supplied from the sheet supplying device, a cutting device for cutting the sheet material on which printing has been performed by the printing device, and a thermal activation device in which the heat-sensitive adhesive layer of the sheet material is heated to generate an adhesion force.

For a related art printer including the thermal activation device, there is disclosed a structure in which an introduction device for introducing a sheet material while bending the sheet material is disposed between a cutting device and a thermal activation device (see, for example, Patent Document 1).

Further, for a structure for temporarily stocking the sheet material, on which the printing has been performed, in the apparatus, there is disclosed a related art printer having a space for stocking the sheet material, on which the printing has been performed, by suspending the sheet material by its own weight (see, for example, Patent Document 2).

[Patent Document 1] JP 2003-316265 A

[Patent Document 2] JP 2001-261228 A

However, the temporary stock portion for a sheet material as disclosed in Patent Document 1 or 2 adopts a method in which, until predetermined processes such as printing and sheet cutting end, the sheet material on which the printing has been performed is bent in a U shape or a bellows shape in a predetermined space, or a method in which the sheet material on which the printing has been performed is suspended in the predetermined space. Accordingly, it is necessary to ensure a relatively large space for stocking the sheet material. Therefore, there is a problem of inviting increase in size of the apparatus as a whole. Thus, it is impossible to apply the temporary stock portions as disclosed in Patent Documents 1 and 2 to small mobile printers which can easily be carried by one hand.

SUMMARY OF THE INVENTION

It is an object of the present invention to provide a thermal activation printer with which it is possible to downsize an apparatus as a whole.

In order to achieve the above-mentioned object, a thermal activation printer according to the present invention includes: printing means for performing printing on a printing layer of a sheet material including a sheet-like base having one surface provided with the printing layer and another surface provided with a heat-sensitive adhesive layer; thermal activation means for heating the heat-sensitive adhesive layer of the sheet material and generating an adhesive force; temporary stock means, which is arranged in a transport path for the sheet material between the printing means and the thermal activation means, for temporarily stocking the sheet material; and a casing covering at least the temporary stock means. The temporary stock means includes a reversing portion provided with a transport path having an arc shape, for reversing a transport direction of the sheet material transported from the printing means and a stock portion, which has a straight line shape and is provided continuously to the reversing portion, for stocking the sheet material in a flat state, the reversing portion and the stock portion being formed along an inner peripheral portion of the casing.

In the thermal activation printer according to the present invention structured as described above, because the reversing portion and the stock portion of the temporary stock means are formed along the inner peripheral portion of the casing covering the temporary stock means, an inner space of the casing is effectively used, thereby downsizing an apparatus as a whole. In the thermal activation printer, the sheet material transported to the reversing portion of the temporary stock means is transported to the stock portion having a straight line shape, thereby allowing the sheet material to be temporarily stocked in the flat state without being curved. Therefore, with the temporary stock means, the sheet material temporarily stocked by the temporary stock means is prevented from causing such a tendency that the sheet material is curved in a lengthwise direction. Further, with the thermal activation printer, the temporary stock means has the reversing portion, thereby making it possible to stock the sheet material of a relatively large length without increasing a size of the apparatus as a whole.

Further, the reversing portion included in the thermal activation printer according to the present invention may have a transport path having a substantially U shape, for transporting the sheet material in a direction substantially opposite to a transport direction of the sheet material carried into the reversing portion. With this structure, the temporary stock means is made compact and the apparatus as a whole is downsized.

At least one of the transport path of the reversing portion and the stock portion included in the thermal activation printer according to the present invention is preferably provided with a transport roller for transporting the sheet material. With this structure, smooth transportation of the sheet material is enabled, and the sheet material is stocked in a favorable manner.

Further, the reversing portion of the temporary stock means included in the thermal activation printer according to the present invention may be provided with a transport roller having an outer peripheral surface forming a transport path. With this structure, the temporary stock means enables smooth transportation of the sheet material, and the sheet material is stocked in a favorable manner.

Further, the stock portion of the temporary stock means included in the thermal activation printer according to the present invention is preferably formed in a tapered shape having a gap in a thickness direction of the sheet material, the gap gradually becoming larger from the reversing portion side along the transport direction of the sheet material. With this structure, a slide resistance between the sheet material entering inside the stock portion and an inside of the stock portion is suppressed, and the sheet material is smoothly transported from the transport path of the reversing portion into the stock portion.

As described above, with the thermal activation printer according to the present invention, it is possible to downsize an apparatus as a whole.

DETAILED DESCRIPTION OF THE PREFERRED EMBODIMENT

Hereinafter, specific embodiments of the present invention will be described with reference to the drawings.

As an example of the printer according to the present invention, a description will be made of a label issuing apparatus used in a case of issuing a label to be stuck to goods for indicating various information on the goods.

A sheet material used for the label issuing apparatus according to this embodiment includes a sheet-like base, a heat-sensitive printing layer provided on a front surface side of the sheet-like base, and a heat-sensitive adhesive layer provided on a back surface side of the sheet-like base. Note that, for the sheet material, there may be provided a structure in which a heat insulating layer for blocking heat transmission from one layer of the sheet-like base to another layer thereof is provided between the sheet-like base and the heat-sensitive printing layer.

First Embodiment

Figure 1:
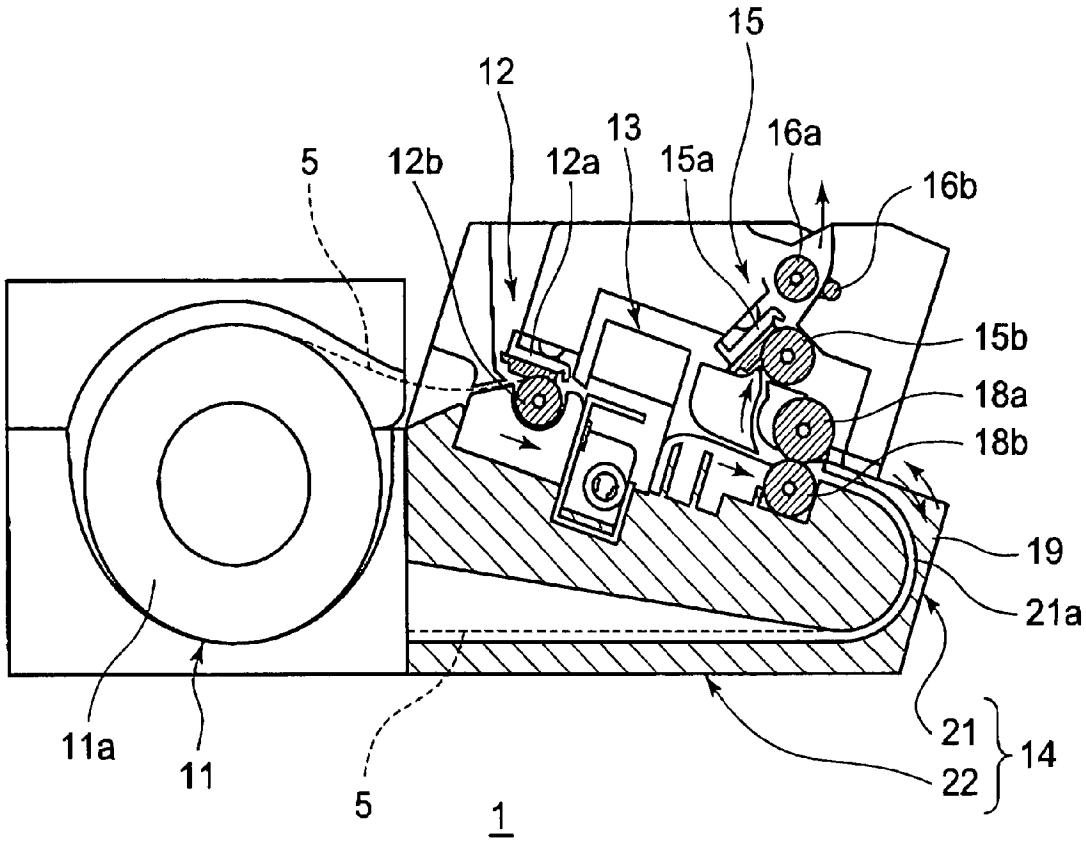
FIG. 1 is a schematic view showing a thermal activation printer according to a first embodiment of the present invention.

As shown in, FIG. 1, a label issuing apparatus 1 according to this embodiment includes, along a transport direction of a sheet material 5 indicated by arrows of FIG. 1, a sheet supplying portion 11 for supplying the sheet material 5, a printing portion 12 for printing various information such as characters on a heat-sensitive printing layer of the sheet material 5, a cutting portion 13 for cutting the sheet material 5, on which the printing has been performed by the printing portion 12, into a predetermined length, a temporary stock portion 14 for temporarily stocking the sheet material 5 on which the printing has been performed by the printing portion 12, a thermally activating portion 15 for heating a heat-sensitive adhesive layer of the sheet material 5 supplied from the temporary stock portion 14 to generate an adhesion force, and a pair of delivery rollers 16*a* and 16*b* for delivering the sheet material 5 to an outside of the apparatus.

In the sheet supplying portion 11, a supplying roll 11*a* around which the sheet material 5 is wound is mounted so as to be rotatable, and the sheet material 5 is supplied by being delivered from the supplying roll 11*a* having an outer diameter of about 50 mm, for example.

The printing portion 12 is a so-called thermal printer and includes a thermal head 12*a* for heating the heat-sensitive printing layer of the sheet material 5 thereby performing coloring, and a platen roller 12*b* brought into press contact with the thermal head 12*a*. The printing portion 12 allows transportation of the sheet material 5 supplied from the sheet supplying portion 11 while sandwiching the sheet material 5 between the thermal head 12*a* and the platen roller 12*b* and performing printing thereon. The thermal head 12*a* is provided with a plurality of heater elements (not shown) arranged along a width direction perpendicular to a transport direction of the sheet material 5.

The cutting portion 13 includes a cutter (not shown) for cutting the sheet material 5 transported from the printing portion 12 into a predetermined length and a cutter drive mechanism (not shown) for driving the cutter.

The temporary stock portion 14 includes a reversing portion 21 provided with a transport path 21*a* having an arc shape, for reversing the transport direction of the sheet material 5 transported from the printing portion 12 and a stock portion 22 having a straight line shape, for temporarily stocking the sheet material 5, which is transported from the reversing portion 21, in a flat state.

Further, the temporary stock portion 14 is provided with a pair of transport rollers 18*a* and 18*b* for transporting the sheet material 5 transported from the printing portion 12 side to the reversing portion 21 and transporting the sheet material 5 which is temporarily stocked to the thermally activating portion 15, and a drive mechanism (not shown) for rotating the transport rollers 18*a* and 18*b*.

Further, the temporary stock portion 14 is covered with a casing 19 and has a structure in which the transport path 21*a* of the reversing portion 21 and the stock portion 22 are formed continuously to each other along an inner peripheral surface of the casing 19. Therefore, a space inside the casing 19 is effectively utilized, thereby making the apparatus compact as a whole and realizing downsizing. Note that the casing 19 according to this embodiment covers only the temporary stock portion 14, but may be formed to extend so as to cover the printing portion 12, the cutting portion 13, and the thermally activating portion 15.

The reversing portion 21 is formed so that a radius of curvature of the transport path 21*a* is about 10 mm, and the transport direction of the sheet material 5 carried in from the printing portion 12 side is reversed in the substantially opposite direction, that is, in a substantially U shape such that the direction of the sheet material 5 is changed by about 180 degrees and the sheet material 5 is transported to the stock portion 22.

The stock portion 22 is provided continuously to the reversing portion 21 and forms a space for temporarily stocking the sheet material 5. Further, the stock portion 22 is formed in a tapered shape having a gap in a thickness direction of the sheet material 5, the gap gradually becoming larger from the reversing portion 21 side along the transport direction of the sheet material 5. Accordingly, a slide resistance between the sheet material 5 entering inside the stock portion 22 and an inside of the stock portion 22 is suppressed, the sheet material 5 is smoothly transported from the transport path 21*a* of the reversing portion 21 into the stock portion 22, and the sheet material 5 is stocked in the stock portion 22 in a favorable manner and in a flat state.

Further, in a transport path for transporting the sheet material 5 from the transport rollers 18*a* and 18*b* to the thermally activating portion 15, there is provided a guide sheet which prevents retrogression of the sheet material 5 from the transport rollers 18*a* and 18*b* to the printing portion 12 side, for guiding the sheet 5 to the thermally activating portion 15.

The drive mechanism controls normal rotation and reverse rotation of the transport rollers 18*a* and 18*b* by detecting the transported sheet material 5 using a sensor (not shown), by measuring a transport time of the sheet material 5, or the like. Therefore, the sheet material 5 on which printing has been performed by the printing portion 12 is stocked by the temporary stock portion 14 owing to the normal rotation of the transport rollers 18*a* and 18*b* and is smoothly transported to the thermally activating portion 15 owing to the reverse rotation of the transport rollers 18*a* and 18*b*.

The thermally activating portion 15 includes a thermally activating head 15*a* for heating the heat-sensitive adhesive layer of the sheet material 5 to generate an adhesion force and a platen roller 15*a* brought into press contact with the thermally activating head 15*a*. In the thermally activating portion 15, the sheet material 5 delivered out from the temporary stock portion 14 is sandwiched between the thermally activating head 15*a* and the platen roller 15*b* to be heated and transported while generating the adhesive force. For the thermally activating head 15*a*, there is used a member which is the same as that used for the thermal head 12*a* included in the printing portion 12.

The delivery rollers 16*a* and 16*b* are arranged on a downstream side in the transport direction of the sheet material 5 with respect to the thermally activating portion 15, and are rotated by a roller drive mechanism (not shown), thereby delivering the sheet material 5 heated by the thermally activating portion 15 to generate the adhesive force to an outside of the apparatus.

A description will be made of an operation of the label issuing apparatus 1 structured as described above, in which the sheet material 5 is stocked in the temporary stock portion 14 and the sheet material 5 stocked therein is delivered from the temporary stock portion 14.

First, in the label issuing apparatus 1, the sheet material 5 on which printing has been performed by the printing portion 12 is transported to the reversing portion 21 of the temporary stock portion 14 in accordance with the rotation of the transport rollers 18*a* and 18*b*. The transport rollers 18*a* and 18*b* are further rotated, thereby allowing the sheet material 5, which has been transported into the reversing portion 21, to be transported along the transport path 21*a* and transported to the stock portion 22. Next, the sheet material 5 is cut into a predetermined length by the cutting portion 13 and is stocked while straddling the transport path 21*a* of the reversing portion 21 and the stock portion 22, and is stocked in a flat state without being bent in the stock portion 22.

Next, in the label issuing apparatus 1, each of the transport rollers 18*a* and 18*b* are rotated in a reverse direction, thereby allowing the sheet material 5 temporarily stocked in the stock portion 22 to be transported along the transport path 21*a* of the reversing portion 21 and transported from the reversing portion 21 to the thermally activating portion 15. The thermally activated layer of the sheet material 5 transported from the temporary stock portion 14 to the thermally activating portion 15 is heated and the adhesion force is generated, and the sheet material 5 is delivered from the label issuing apparatus 1 by the delivery rollers 16*a* and 16*b*.

As described above, in the label issuing apparatus 1, the reversing portion 21 and the stock portion 22 of the temporary stock portion 14 are formed along the inner peripheral surface of the casing 19 covering the temporary stock portion 14, thereby allowing an inner space of the casing 19 to be effectively utilized, so it is possible to downsize the apparatus as a whole.

Further, in the label issuing apparatus 1, the temporary stock portion 14 has the reversing portion 21 and the stock portion 22 of the straight line shape, thereby making it possible to suppress curling in a lengthwise direction of the sheet material 5 stocked in the temporary stock portion 14.

Further, because the temporary stock portion 14 has the reversing portion 21 for reversing the transport direction of the sheet material 5, it is possible to stock the sheet material 5 having a relatively long length without making the apparatus larger as a whole. Further, because the reversing portion 21 of the temporary stock portion 14 has the transport path 21*a* for performing the transportation while reversing the transport direction of the sheet material 5 to the direction substantially opposite to the transport direction of the sheet material S'carried into the reversing portion 21, the temporary stock portion 14 is made compact, thereby downsizing the apparatus as a whole.

Hereinafter, a description will be made of a label issuing apparatus according to another embodiment of the present invention with reference to the drawings. Note that the label is suing apparatus according to the another embodiment is different from the label issuing apparatus 1 according to the first embodiment of the present invention in structure of the temporary stock portion. Accordingly, the structures other than the temporary stock portion are denoted by the same reference symbols as those of the first embodiment and the descriptions of those will be omitted.

Second Embodiment

Figure 2:
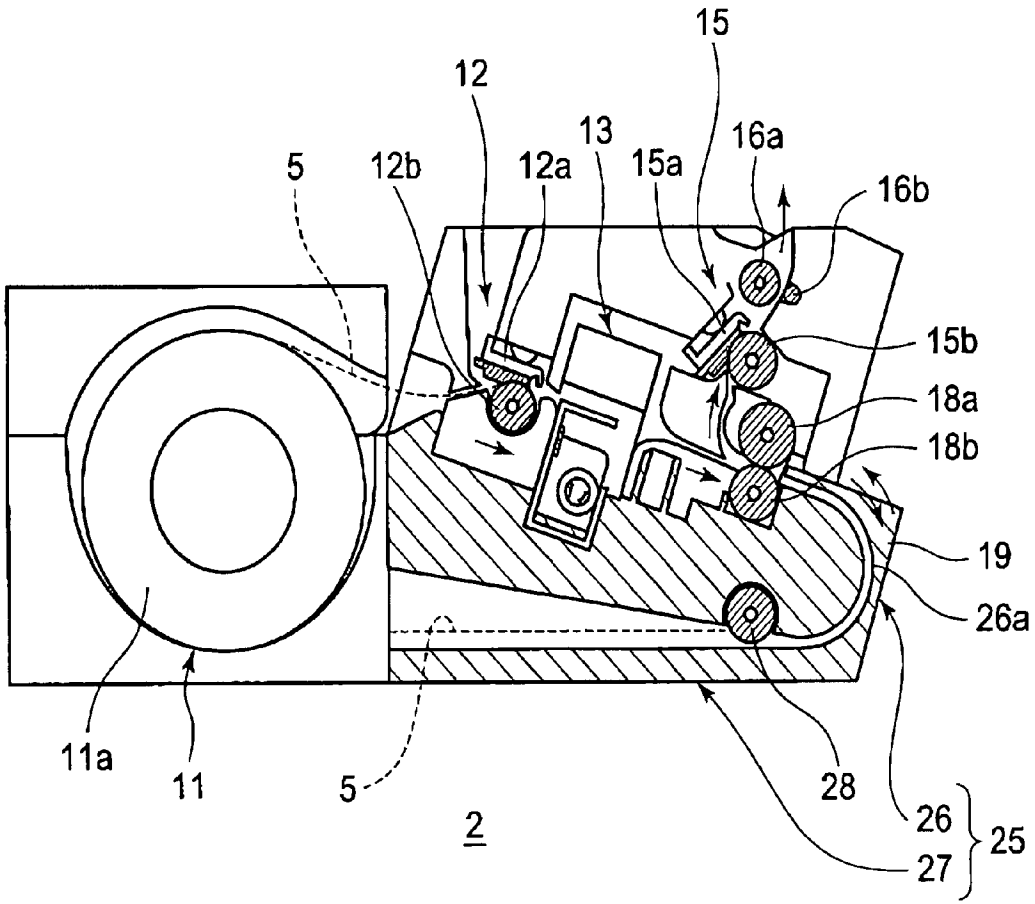
FIG. 2 is a schematic view showing a thermal activation printer according to a second embodiment of the present invention.

As shown in FIG. 2, a temporary stock portion 25 included in a label issuing apparatus 2 of a second embodiment of the present invention includes a reversing portion 26 having a transport path 26*a* having an arc shape, for reversing the transport direction of the sheet material 5 transported from the printing portion 12 and a stock portion 27 having a straight line shape, for temporarily stocking the sheet material 5, which is transported from the reversing portion 26, in a flat state.

In the reversing portion 26, at an end portion on the stock portion 27 side of the transport path 26*a*, there is disposed a transport roller 28 for transporting the sheet material 5. The transport roller 26 is rotated in synchronism with the transport rollers 18*a* and 18*b* by a rotation drive mechanism (not shown), thereby smoothly transporting the sheet material 5 from the reversing portion 26 to the stock portion 27.

The stock portion 27 is provided continuously to the reversing portion 26 and forms a space for temporarily stocking the sheet material 5. Further, similarly to the stock portion 22 described above, the stock portion 27 is formed in a tapered shape having a gap in the thickness direction of the sheet material 5, the gap gradually becoming larger from the reversing portion 26 side along the transport direction of the sheet material 5. Accordingly, the sheet material 5 is smoothly transported from the reversing portion 26 into the stock portion 27, and the sheet material 5 is stocked in the stock portion 27 in a favorable manner and in a flat state.

In the temporary stock portion 25 structured as described above, the transport rollers 18*a* and 18*b* and the transport roller 28 are rotated in synchronism with each other, thereby allowing the sheet material 5 transported from the printing portion 12 side to the reversing portion 26 to be smoothly transported from the reversing portion 26 to the stock portion 27 and stocked in the stock portion 27. Further, in the temporary stock portion 25, each of the transport rollers 18*a* and 18*b* and the transport roller 28 are rotated in the reverse direction, the sheet material 5 stocked in the stock portion 27 is transported along the transport path 26*a* of the reversing portion 26 to be transported from the reversing portion 26 to the thermally activating portion 15. Therefore, the transport roller 28 supports the transportation of the sheet material 5 by the transport rollers 18*a* and 18*b*.

With the temporary stock portion 25 included in the label issuing apparatus 2 of this embodiment, the sheet material 5 is smoothly transported by the transport roller 28 rotated in synchronism with the transport rollers 18*a* and 18*b*, and it is possible to stock the sheet material 5 in the stock portion 27 in a favorable manner without causing the sheet material 5 to be curled in the lengthwise direction thereof.

Note that the label issuing apparatus 2 of this embodiment adopts a structure in which the transport roller 28 is disposed between the transport path 26*a* of the reversing portion 26 and the stock portion 27. However, for example, there may be adopted a structure in which the transport roller 28 is disposed in the stock portion 27 or in a middle portion of the transport path 26*a* of the reversing portion 26, or a structure in which another transport roller (not shown) is additionally disposed as needed, thereby enabling smooth transportation of the sheet material 5 to the stock portion 27.

Third Embodiment

Figure 3:
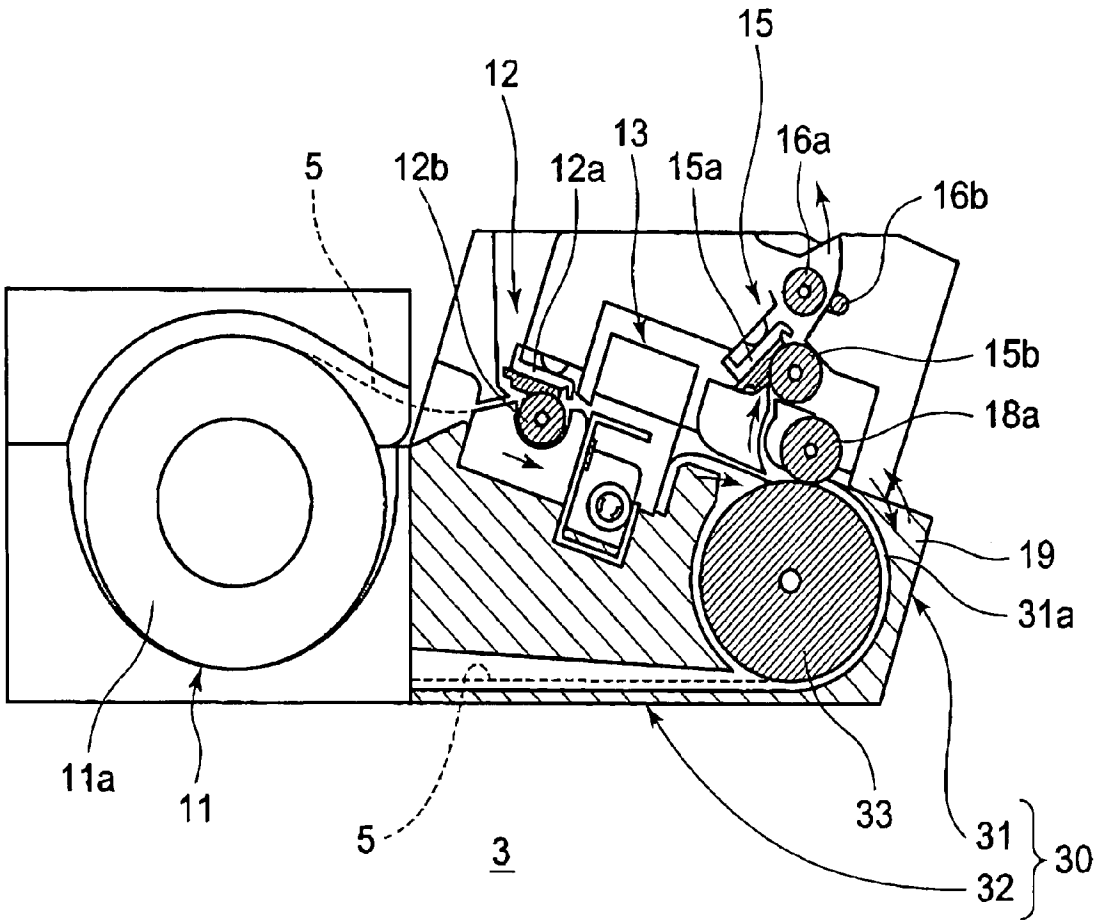
FIG. 3 is a schematic view showing a thermal activation printer according to a third embodiment of the present invention.

As shown in FIG. 3, a temporary stock portion 30 included in a label issuing apparatus 3 of a third embodiment of the present invention includes a reversing portion 31 having a transport path 31*a* having an arc shape, for reversing the transport direction of the sheet material 5 transported from the printing portion 12 and a stock portion 32 having a straight line shape, for temporarily stocking the sheet material 5, which is transported from the reversing portion 31, in a flat state.

In order to transport the sheet material 5, which is transported from the printing portion 12 side, to the reversing portion 21 and to transport the sheet material 5, which is temporarily stocked, to the thermally activating portion 15, the reversing portion 31 includes the transport roller 18*a* and a transport roller 33 having an outer peripheral surface brought into contact with the transport roller 18*a*. The transport roller 33 is formed to have a diameter of about 20 mm and the transport path 31*a* is structured of an outer peripheral surface of the transport roller 33 and an inner peripheral surface of the casing 19.

The sheet material 5 is transported from the printing portion 12 to the reversing portion 31 by the transport roller 18*a* and the transport roller 33 and is transported from the reversing portion 31 to the stock portion 32 by the transport roller 33. Therefore, the transport roller 33 according to this embodiment also functions as the transport roller 18*b*, the transport path 26*a* of the reversing portion 26, and the transport roller 28 according to the second embodiment described above.

The stock portion 32 is provided continuously to the reversing portion 31 and forms a space for temporarily stocking the sheet material 5. Further, similarly to the stock portion 22, 27, the stock portion 32 is formed in a tapered shape having a gap in the thickness direction of the sheet material 5, the gap gradually becoming larger from the reversing portion 31 side along the transport direction of the sheet material 5. Accordingly, the sheet material 5 is smoothly transported from the reversing portion 31 into the stock portion 32, and the sheet material 5 is stocked in the stock portion 32 in a favorable manner and in a flat state.

In the temporary stock portion 30 structured as described above, the transport roller 18*a* and the transport roller 33 are rotated in synchronism with each other, thereby allowing the sheet material 5 transported from the printing portion 12 side to the reversing portion 31 to be smoothly transported from the reversing portion 31 to the stock portion 32 to be stocked in the stock portion 32. Further, in the temporary stock portion 30, each of the transport roller 18*a* and the transport roller 33 are rotated in the reverse direction, thereby allowing the sheet material 5 stocked in the stock portion 32 to be transported along the transport path 31*a* of the reversing portion 31 and transported from the reversing portion 31 to the thermally activating portion 15.

With the temporary stock portion 30 included in the label issuing apparatus 3 of this embodiment, the sheet material 5 is smoothly transported by the transport roller 33 and it is possible to stock the sheet material 5 in the stock portion 32 in a favorable manner without causing the sheet material 5 to be curled in the lengthwise direction thereof.

What is claimed is:

1. A thermal activation printer, comprising:

printing means for performing printing on a printing layer of a sheet material including a sheet-like base having one surface provided with the printing layer and another surface provided with a heat-sensitive adhesive layer;

thermal activation means for heating the heat-sensitive adhesive layer of the sheet material and activating the heat-sensitive adhesive layer;

temporary stock means, which is arranged in a transport path for the sheet material between the printing means and the thermal activation means, for temporarily stocking the sheet material; and a casing covering at least the temporary stock means, wherein the temporary stock means comprises a reversing portion provided with a transport path having an arc shape, for reversing a transport direction of the sheet material transported from the printing means and a stock portion, which guides the sheet material in a substantially a straight line direction and is provided continuously to the reversing portion, for stocking the sheet material in a flat state, the reversing portion and the stock portion being formed along an inner peripheral portion of the casing.

2. A thermal activation printer according to claim 1, wherein the reversing portion comprises the transport path having a substantially U shape, for transporting the sheet material in a direction substantially opposite to a transport direction of the sheet material which is carried in.

3. A thermal activation printer according to claim 1, wherein at least one of the transport path of the reversing portion and the stock portion is provided with a transport roller for transporting the sheet material.

4. A thermal activation printer according to claim 1, wherein the reversing portion is provided with a transport roller having an outer peripheral surface forming the transport path.

5. A thermal activation printer according to claim 1, wherein the stock portion is formed in a tapered shape including a gap in a thickness direction of the sheet material, the gap gradually becoming larger from a side of the reversing portion along the transport direction of the sheet material.

* * * * *